US008978429B2

(12) United States Patent
Zhao et al.

(10) Patent No.: US 8,978,429 B2
(45) Date of Patent: Mar. 17, 2015

(54) FLIP KEY FOR AN AUTOMOTIVE VEHICLE WITH ENHANCED RESISTANCE TO FORCES EXERTED ONTO AN INSERT OF SUCH FLIP KEY

(75) Inventors: Lin Zhao, Martorellas (ES); Zdenek Mrazek, Martorellas (ES); Victor Villagrasa, Martorellas (ES)

(73) Assignee: Valeo Climatizacion, SAU, Martorellas (ES)

( * ) Notice: Subject to any disclaimer, the term of this patent is extended or adjusted under 35 U.S.C. 154(b) by 0 days.

(21) Appl. No.: 13/992,061

(22) PCT Filed: Nov. 14, 2011

(86) PCT No.: PCT/EP2011/070031

§ 371 (c)(1),
(2), (4) Date: Oct. 2, 2013

(87) PCT Pub. No.: WO2012/076291

PCT Pub. Date: Jun. 14, 2012

(65) Prior Publication Data

US 2014/0020439 A1 Jan. 23, 2014

(30) Foreign Application Priority Data

Dec. 6, 2010 (EP) ..... 10015329

(51) Int. Cl.
*A44B 15/00* (2006.01)
*E05B 19/04* (2006.01)

(52) U.S. Cl.
CPC ..... *E05B 19/043* (2013.01)
USPC ..... 70/456 R; 70/408

(58) Field of Classification Search
USPC ..... 70/393, 395, 396, 397, 399, 405, 408, 70/456, 456 R
See application file for complete search history.

(56) References Cited

U.S. PATENT DOCUMENTS 6,499,326 B1 * 12/2002 Heussner ..... 70/399
6,705,141 B1 * 3/2004 Jacob et al. ..... 70/408

(Continued)

FOREIGN PATENT DOCUMENTS

DE 10 2006 036503 A1 2/2008
WO 01/48342 A1 7/2001
WO 2010/023293 A1 3/2010

OTHER PUBLICATIONS

International Search Report issued in PCT/EP2011/070031 mailed on Feb. 13, 2012 (3 pages).

*Primary Examiner* — Christopher Boswell
(74) *Attorney, Agent, or Firm* — Osha Liang LLP

(57) ABSTRACT

The invention relates to an automotive vehicle key in which a button (30) maintains by means of two legs (32, 33) a rotatable bearing (20) and a housing (40) fixed in mutual rotation at least in a situation where the key is in open position, the rotatable bearing (20) presenting an elongated shape so that the rotatable bearing (20) presents at least a longer dimension (a) and at least a shorter dimension (b) transversal to the said at least one longer dimension (a), wherein one leg (33) of the said at least two legs (32, 33) extends sensibly in the direction of the longer dimension (a) and the other leg (32) of the at least two legs (32,33) extends sensibly in the direction of the shorter transversal dimension (b), and the leg (33) extending in the direction of the longer dimension (a) is longer along said longer direction (a) than the leg (32) which extends in the direction of the transversal dimension (b).

6 Claims, 2 Drawing Sheets

(56) References Cited

U.S. PATENT DOCUMENTS

| | | | | |
|---|---|---|---|---|
| 7,055,352 | B2 * | 6/2006 | Meyerson et al. | 70/456 R |
| 7,370,501 | B2 * | 5/2008 | Miyata et al. | 70/395 |
| 8,225,633 | B2 * | 7/2012 | Luo et al. | 70/456 R |
| 8,266,936 | B2 * | 9/2012 | Box et al. | 70/408 |
| 8,616,032 | B2 * | 12/2013 | Holowin et al. | 70/456 R |
| 8,695,389 | B2 * | 4/2014 | Gueble | 70/456 R |
| 2007/0062229 | A1 * | 3/2007 | Miyata et al. | 70/408 |
| 2007/0220936 | A1 | 9/2007 | Miyata et al. | |
| 2012/0285208 | A1 * | 11/2012 | Delande et al. | 70/399 |

* cited by examiner

FLIP KEY FOR AN AUTOMOTIVE VEHICLE WITH ENHANCED RESISTANCE TO FORCES EXERTED ONTO AN INSERT OF SUCH FLIP KEY

The invention relates to a key for access and/or ignition of automotive vehicles, in particular such key comprising an insert and a rotatable bearing supporting the insert so that the insert is rotatable in and out of a housing of the key between an open position and a closed position.

Such keys, known as flip keys are advantageous in terms as having a low volume when flipped into the closed position and in terms of being easy to handle manually when in the open position. Indeed, as the housing of such key is aimed at receiving both the insert, a rotating mechanism for the rotation of the insert, and also an electronic equipment for remote unlocking of the vehicle, the housing is usually large in size and hence constitutes a strong and comfortable area for prehension by the end-user.

A drawback appears with such keys due to their ability to be strongly handled. Indeed users which are faced with an urgent need for a tool in their every day life, for example for opening a can, spinning a screw, extracting a pin, scratching in any type of cavity, etc. . . . are often prone to using such a key in the role and in replacement of such a needed tool.

There results from such situation that flip keys are oftentimes inadvertently damaged, in particular at the level of the rotatable bearing of the insert, which gets no more able to be maintained firmly in its open position for use in a lock of the vehicle.

It is an aim of the invention to propose a flip key which is more robust to such undue use of the key as an improvised tool. It is more generally an aim of the invention to propose a key which is more robust to damages in current use and in particular is more robust against damages of the rotation mechanism of the key.

These aims are achieved by way of the invention as recited in appended claim 1.

Other features, aims and advantages of the invention will appear throughout the detailed description which is made here-after, made in reference to the appended drawings, among which:

Figure 1:
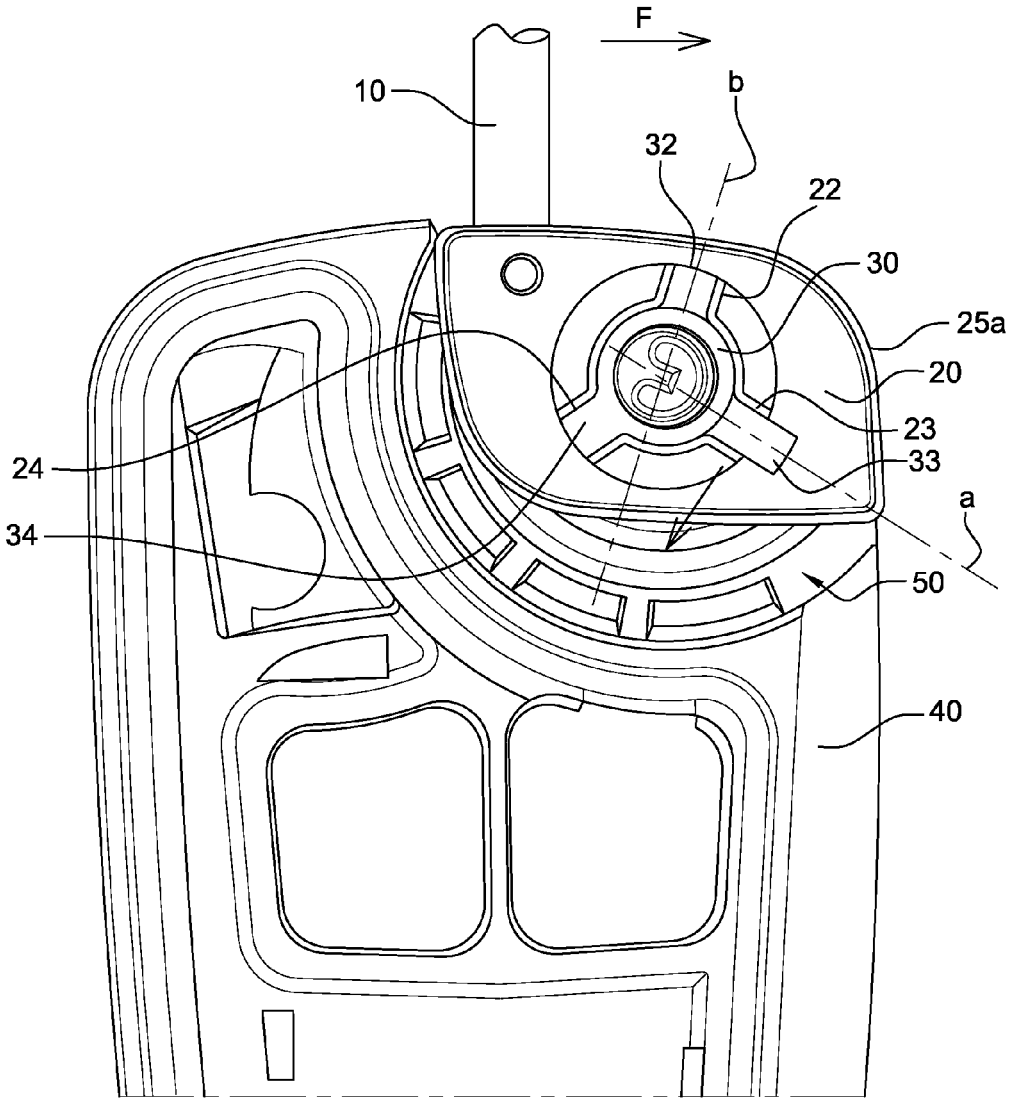
FIG. 1 is a partial underneath view of a flip key according to an embodiment of the invention.
Figure 2:
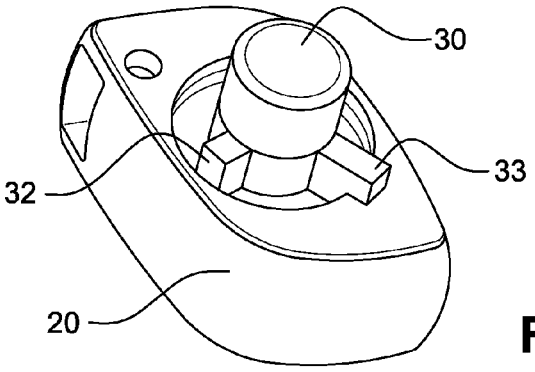
FIG. 2 is a perspective view of a rotatable bearing for a insert of such same flip key.
Figure 3:
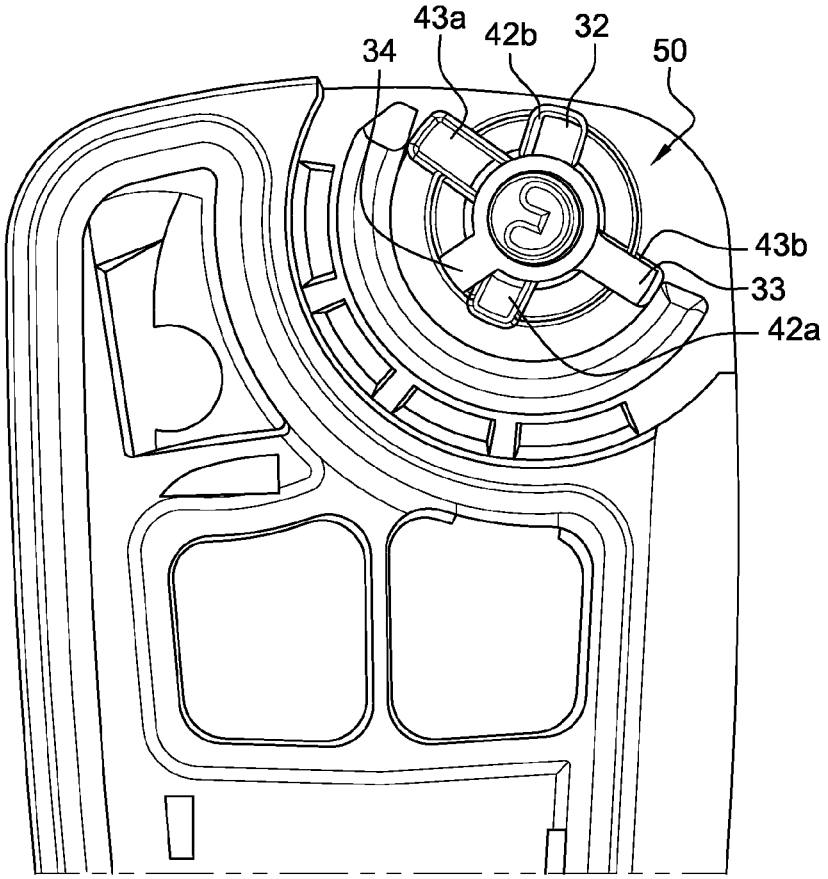
FIG. 3 is a partial underneath view of a flip key according to the same embodiment, without the rotatable bearing of the insert

The flip key represented on FIG. 1 comprises an insert 10, a rotatable bearing 20, a push button 30 and an upper cover 40 of a housing of the key.

The rotatable bearing 20 is mounted with freedom to rotate inside the housing, by means of the push button 30 which here constitutes a rotation shaft for the rotatable bearing 20. For this purpose, the rotatable bearing 20 comprises a through hole 31 in which the push button 30 extends so that the push button 30 emerges through the upper cover of the housing 40. A lower cover of the housing which is not represented here comprises a finger which emerges from an internal face of the lower cover so as to emerge inside the push button 30 and hence maintain the push button 30 against any movement along a main plane of upper and lower covers.

The push button 30 comprises a cylindrical main body and a series of three radially extending legs 32, 33, 34 which are engaged in corresponding anchoring cavities having the shape of radial grooves in the rotatable bearing 20. This way, the push button 30 and the rotatable bearing 20 are fixed each other in mutual rotation.

Figure 4:
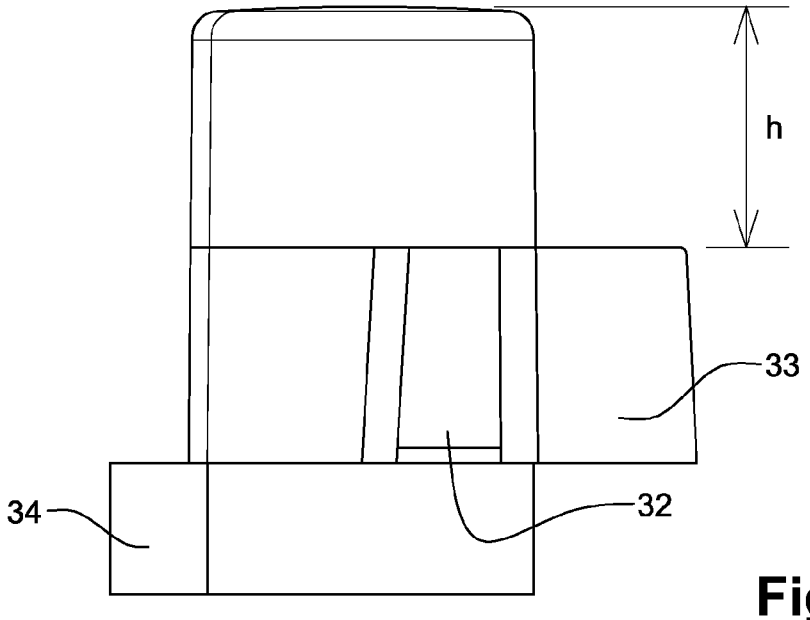
FIG. 4 is a view of a side view of a push button according to the same embodiment of the invention.

As represented on FIG. 4, two legs 32, 33, are located at around half height of button, with a thickness of around one third of the height of the button. Last leg 34 is located at a lower level of the push-button 30. The push button 30 comprises a free height h above legs 32 and 33. Such height h corresponds to the thickness of the upper cover 40 of the housing added with a height of a portion of the push button desiredly emerging out of the upper cover 40 of the housing.

The rotatable bearing 20 comprises anchoring cavities, in the shape of radial grooves 22, 23 and 24 which respectively receive the legs 32, 33, 34 of the push-button. Theses anchoring grooves 22, 23, 24 present a thoroughness which is greater than the part of the legs 32, 33, 34 which is engaged in the rotatable bearing, so that legs 32, 33, and 34 have a freedom to be displaced along the main direction of the push button inside the rotatable bearing 20 without exiting out of the rotatable bearing.

The push button 30 is pressed into an idle upper position by means of a helicoidal spring and in this idle position, legs 32 and 33 of the push-button have a part which emerges above an upper face of the rotatable bearing 20. The upper cover 40 of the housing has an underneath face which comprises a series of radially oriented anchoring cavities having the shape of radial grooves 42*a*, 43*a*, 42*b*, 43*b* for receiving legs 32 and 33. More specifically, radially oriented anchoring grooves 42*a* and 43*a* are positioned so as to receive the upper emerging part of legs 32, 33 when the rotatable bearing is in closed position of the key, while the radially oriented anchoring grooves 42*b* and 43*b* are located so as to receive the upper emerging part of legs 32, 33 when the rotatable bearing is in open position of the key. In each one of these positions, legs 32, 33 present a lower part which is engaged in a respective anchoring groove 22, 23 of the rotatable bearing so that the rotatable bearing is maintained against rotation by means of the legs 32, 33 engaged both into the upper cover 40 of the housing and into the rotatable bearing 20.

When the user pushes the button 30, then the upper emerging part of the legs 32, 33 exits from the anchoring grooves 42*a*, 43*a* or 42*b*, 43*b* thereby freeing the rotatable bearing 20 in rotation as the legs 32, 33 are then engaged solely in the rotatable bearing 20.

During this process, lower leg 34 slides inside anchoring groove 24 of the rotatable bearing and comes in abutment with the lower cover of the housing, without any contact with the upper cover 40 of the housing. The lower leg 34 hence acts as a lower abutment of the button 30 in a lower slidable position of the button and constitutes a further maintaining element for solidarizing the push-button 30 and the rotatable bearing 20 in rotation and opposing rotation of the button while the other legs 32, 33 are engaged in the radially oriented anchoring grooves 42*a*, 43*a* or 42*b*, 43*b* of the upper cover 40 of the housing.

In the open situation represented on FIG. 1, when the user exerts a force onto the insert 10 which tends to flip the insert towards the closed position thereof, a torque appears onto the rotatable bearing 20. Due to this torque, each one of legs 32 and 33 is subject to a double and opposite effort from the rotatable bearing 20 and from the upper cover 40 of the housing, resulting in a transversal shear or scissors efforts onto each leg 32, 33.

Rotatable bearing 20 is located at a corner of the housing and fills a cavity 50 formed in the housing which is dedicated to rotation of the rotatable bearing.

As the rotatable 20 bearing has its center located close to the edges of the housing, the rotatable bearing 20 comprises a restricted edge 25*a* conformed to the corner of the housing.

More precisely, the rotatable bearing 20 presents two opposite and centrally symmetrical edges 25*a* and 25*b* which both have the same shape as the corner of the housing, these two opposite edges 25*a* and 25*b* rejoining each other at their extremities so as to form angular extremity corners 26*a* and 26*b*. The rotatable bearing hence here resembles like a seashell having an elongated shape.

In a main rotating plane of the rotatable bearing, i.e. a plane which is perpendicular to the axis of rotation of the rotatable bearing embodied by the push button, different dimensions of the rotatable bearing can be determined and in particular a couple of directions can be determined comprising a direction a and a direction b in which the rotatable bearing is respectively longer and shorter in such main plane of rotation. In the present example, direction a is defined here as the direction where the rotatable bearing 20 is the longest possible. As a result this direction a corresponds to an axis which crosses opposite extremity angular corners 26*a* and 26*b* where the opposite and equal shapes 25*a* and 25*b* adjoin each other.

However, it will be understood in the course of the following description that other such directions which are longer than a complementary transversal direction may be defined on such an elongated shape of the rotatable bearing and that constitute the longer direction of a couple of directions made of a longer and a shorter direction.

For example, instead of defining the longer direction a as being the one which crosses the extremity angles 26*a*, 26*b* of the rotatable bearing 20, the longer direction a may be a direction which is the direction perpendicular to a main longitudinal axis of the housing when the rotatable bearing 20 is in a position corresponding to either the open or the closed position of the key. A longer position a chosen this way is a position in which the longer leg 33 hence becomes perpendicular to the main longitudinal direction of the key when the key is in the open or in the closed position.

The present shorter direction b is chosen here so as to be close to perpendicular relative to the longer direction a, more precisely here a bit more spaced than perpendicular relative to direction a as will be described again below.

The above described directions a and b are chosen here as the directions in which legs 33 and 32 respectively extend. Leg 32 is extending in a shortest direction of the rotatable bearing and presents a radial length which is quite equivalent to half radius of the cylindrical main body of the push-button 30.

On the contrary, leg 33 extends in a longer direction a of the rotatable bearing and leg 33 is dimensioned here with a longer radial length than the length of leg 32. This longer length of leg 32 is made possible in the case of leg 33 by the fact that a large amount of constitutive material of the rotatable bearing 20 is present in the area which neighbours the extremity of leg 33 in the rotatable bearing 20. In the present case, length of leg 33 is high enough so that leg 33 would have is longer than a radial dimension of the rotatable bearing 20 in the shortest direction, so that leg 33 would have emerged laterally from the rotatable bearing 20 if it had been oriented in the direction of the shortest dimension.

The anchoring groove 23 which receives the elongated leg 33 in the rotatable bearing 20 presents a length equal to the length of leg 33. Similarly, the radial anchoring grooves 43*a* and 43*b* which are aimed at receiving the longer leg 33 have the same radial length as the length of leg 33.

The longer leg 33 thus engages both the rotatable bearing 20 and the upper cover 40 of the housing throughout the whole length of longer leg 33. A particularly strong force of interaction opposing rotation of the rotatable bearing 20 appears due to the fact that the leg 33 interlocks the upper cover 40 and the rotatable bearing 20 on a particularly large area.

As depicted on FIG. 1, a force F exerted onto the insert 10 is transformed into a force F' appearing between anchoring groove 23 of the rotatable bearing and leg 33 as well as between leg 33 and anchoring groove 43*b* of the cover 40. Force F onto the inset also transforms into a force F" appearing between anchoring groove 22 of the rotatable bearing and leg 32 as well as between leg 32 and radial anchoring groove 42 of the cover 40. Forces F' and F" are repatriated on the whole lengths respectively of leg 33 and leg 32 so as to oppose force F onto the insert 10 and maintain the rotatable bearing against undue rotation.

As the length of leg 33 is particularly high, force F' can reach a particularly high amount before a damage appears at the contact area between leg 33 and rotatable bearing 20 as well as between leg 33 and upper cover 40.

Hence force F can reach a particularly high value before the rotatable bearing 20 begins a rotation in the housing through any damage between housing, button and rotatable bearing.

In the present example, the main body of the button is close to 8 mm in diameter, and the longer leg 33 is 3.5 mm in diameter while the shorter leg 32 is 2 mm in diameter.

While it is preferred in terms of volume and robustness to adopt a longer leg which is longer around 1.5 mm more than the shorter leg, the longer leg is preferably higher than the length of the shorter leg in a range of 1 mm to 2 mm of length increase between both lengths. With such dimensions, a force F of 150N can be applied onto the insert 10 without any damage on the key components.

Of course, one advantage of such a longer leg oriented in a longer direction of the shape of the rotatable bearing 20 and a shorter leg in a transversal direction has been described here in connection to a push button 30 engaging into the upper cover of the housing. However, any other assembly using such a couple of legs comprising a longer leg can be imagined without departing from the invention.

In particular, longer leg 33 can be engaged into the lower cover of the housing, the leg 33 and possibly also leg 32 being permanently engaged in a respective anchoring groove of the lower cover while being able to exit underneath of a corresponding anchoring groove of the rotatable bearing when the push button is pressed by the user. In such case, the push button may be a rotationally fixed push button relative to the housing of the key.

Longer leg 33 and/or shorter leg 32 may also be permanently engaged in the upper cover 40 of the housing, while another leg is selectively engaged in the push button, able to exit a corresponding anchoring groove of the push button through an underneath area of such push button. Such other leg may also be a longer leg extending in a longer direction of the rotatable bearing as compared to a direction in which extends a shorter leg of such push button

The invention claimed is:

1. An automotive vehicle key comprising:

an insert for being introduced into a lock of a vehicle;

a rotatable bearing supporting the insert;

a housing wherein the bearing is mounted in the housing in a rotatable manner so that the insert and the rotatable bearing can rotate between an open position in which the insert extends outside the housing and a closed position in which the insert extends internally in the housing; and a button extending inside the rotatable bearing, the button comprising at least two anchoring legs, the rotatable bearing comprising two anchoring cavities and the housing comprising two anchoring cavities, the anchoring cavities of the rotatable bearing and of the housing being arranged so that each one of the two legs gets anchored simultaneously into both an anchoring cavity of the housing and an anchoring cavity of the rotatable bearing so that the button maintains by the two legs the rotatable bearing and the housing fixed in mutual rotation at least in a situation where the key is in open position, the rotatable bearing presenting an elongated shape so that the rotatable bearing presents at least a longer dimension (a) and at least a shorter dimension (b) transversal to the at least one longer dimension (a), wherein when the rotatable bearing is in the open position, one leg of the at least two legs extends sensibly in the direction of the longer dimension (a) and the other leg of the at least two legs extends sensibly in the direction of the shorter transversal dimension (b), and the leg extending in the direction of the longer dimension (a) is longer along said longer direction (a) than the leg which extends in the direction of the transversal dimension (b).

2. The automotive vehicle key according to claim 1, wherein the leg which extends in the direction of the longer dimension (a) is longer by an amount which is between 1 and 2 mm than the leg which extends in the direction of the transversal dimension (b).

3. The automotive vehicle key according to claim 1, wherein the leg which extends in the direction of the longer dimension (a) is longer by approximately 1.5 mm than the leg which extends in the direction of the transversal dimension (b).

4. The automotive vehicle key according to claim 1, wherein the legs are engaged into respective anchoring cavities of a cover of the housing and the legs are displaceable so as to exit from the anchoring cavities of the housing and thereby render the rotatable bearing and the push-button free to rotate in the housing.

5. The automotive vehicle key according to claim 1, wherein the legs are engaged into respective anchoring cavities of the rotatable bearing and the legs are displaceable so as to exit from the anchoring cavities of the rotatable bearing when the push-button is pushed by a user and thereby render the rotatable bearing free to rotate in the housing.

6. The automotive vehicle key according to claim 5, wherein the legs remain engaged into the anchoring cavities of the housing when the push-button is pushed so that the push button remains fixed in rotation in the housing.

* * * * *